United States Patent [19]

Nozawa

[11] 4,305,530

[45] Dec. 15, 1981

[54] LIQUID ATOMIZER

[75] Inventor: Takamitsu Nozawa, Tokyo, Japan

[73] Assignee: Yoshino Kogyosho Co., Ltd., Tokyo, Japan

[21] Appl. No.: 164,049

[22] Filed: Jun. 30, 1980

Related U.S. Application Data

[63] Continuation of Ser. No. 871,702, Jan. 23, 1978.

[51] Int. Cl.[3] ..... B05B 9/04

[52] U.S. Cl. ..... 222/321; 222/380; 222/385; 239/333

[58] Field of Search ..... 239/331, 333; 222/385, 222/321, 380, 383

[56] References Cited

U.S. PATENT DOCUMENTS

| | | | |
|---|---|---|---|
| 3,627,206 | 12/1971 | Boris | 222/321 |
| 3,908,870 | 9/1975 | Nozawa | 222/321 |
| 3,923,250 | 12/1975 | Boris | 222/321 |
| 4,051,983 | 10/1977 | Anderson | 239/333 X |
| 4,089,442 | 5/1978 | Hafele | 222/385 X |

FOREIGN PATENT DOCUMENTS

| | | | |
|---|---|---|---|
| 2542851 | 4/1976 | Fed. Rep. of Germany | 239/333 |
| 2310163 | 12/1976 | France | 222/321 |

*Primary Examiner*—Andres Kashnikow

[57] ABSTRACT

A cylinder in which a liquid pressurizing chamber is formed is inserted into a liquid container. The cylinder has an unitary large-diameter portion and a small-diameter portion. A first piston is slidably received by the large-diameter portion of the cylinder. The cylinder also slidably receives an operation body including a second piston slidably in the large-diameter portion and a third piston slidably in the small-diameter portion. The liquid in the pressurizing chamber defined by the cylinder and the pistons is pressurized as the operation body is depressed overcoming a force of a spring. A stop valve mounted on the second piston is opened in response to the pressure generated in the pressurizing chamber, so that the liquid is allowed to reach, through a passage formed in the first piston, a nozzle for atomizing the liquid.

5 Claims, 2 Drawing Figures

LIQUID ATOMIZER

This is a continuation of Application Ser. No. 871,702, filed Jan. 23, 1978.

BACKGROUND OF THE INVENTION

The present invention relates to a liquid atomizer capable of performing an atomizing apray by an opening of a valve after a building up of a pressure higher than a predetermined pressure of the liquid in a pressurizing chamber.

In typical conventional accumulator type liquid atomizer, the liquid is sucked and pressurized by a reciprocatorily movement of a piston within a cylinder. The pressurized liquid in a pressurizing chamber is atomized and sprayed from a nozzle, through a valve. However, this type of conventional liquid atomizer involved a substantial problem in relation with a mechanism for operating the valve in response to the pressure within the pressurizing chamber.

More specifically, since a valve chamber for actuating the valve to open is mounted above the neck portion of the liquid container, the centroid of the atomizer as a whole is positioned at relatively upper portion of the latter, so as to deteriorate the stability of the liquid atomizer.

In addition, since the valve chamber is formed separately from the liquid pressurizing chamber, the whole structure of the chamber is rendered complicated, to make the mass-production of the atomizer difficult.

Although some of conventional atomizers have the valve chamber disposed at the neck portion of the liquid container, such a modification is far from simplifying the structure, because the valve chamber is formed separately from the liquid pressurizing chamber.

In these conventional liquid atomizers, a smooth atomizing operation is often failed, because the piston, which has to be depressed for the atomization, is placed at relatively high portion of the atomizer and slidingly engages the inner wall of the cylinder only at one peripheral edge thereof.

OBJECTS OF THE INVENTION

It is therefore a principal object of the invention to simplify the construction of the valve actuating mechanism for actuating the valve in response to the pressure within the pressurizing chamber.

It is another object of the invention to install the valve actuating mechanism at a relatively low position on the atomizer, so as to lower the centroid, thereby to attain a smooth and easy atomizing spray.

It is still another object of the invention to provide a rod-like member in the pressurizing chamber, so as to enhance the pressurizing efficiency, and to provide a ventilation bore for supplying air into the container, thereby to prevent the generation of vacuum in the latter.

DETAILED DESCRIPTION OF THE PREFERRED EMBODIMENTS

Figure 1:
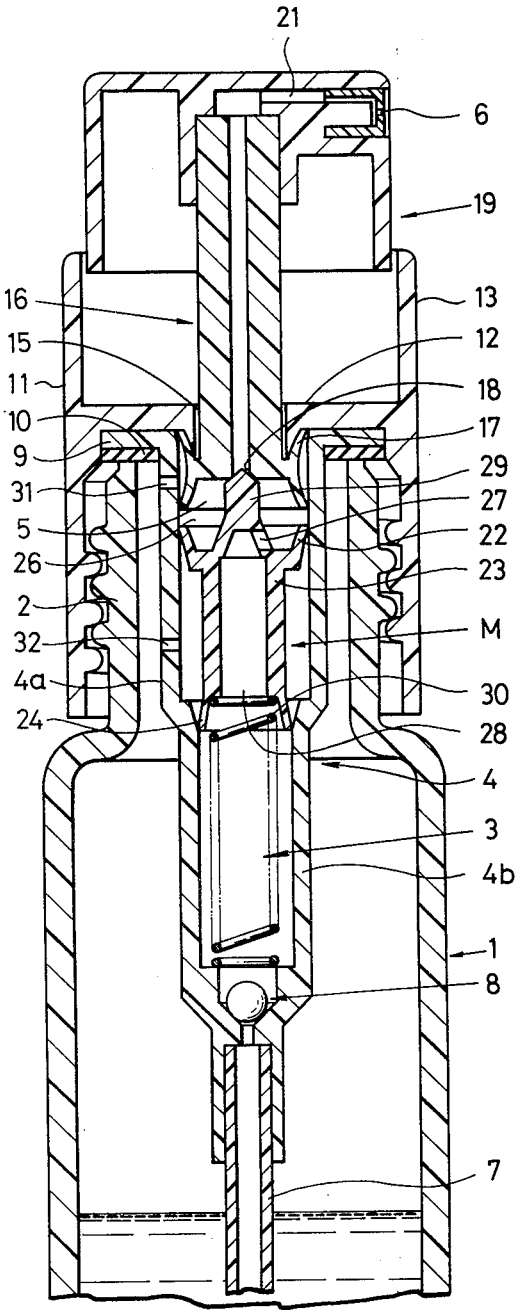
FIG. 1 is a longitudinal sectional view of a liquid atomizer embodying the present invention.

Referring first to FIG. 1 showing a first embodiment of the invention, a tubular neck portion 2 is formed at the upper portion of a liquid container 1. A cylinder 4, in which a pressurizing chamber 3 for pressurizing the liquid, is inserted into the container 1 through the opening of the neck portion 4. The general arrangement of the liquid atomizer in accordance with the invention is such that the liquid is press-fed from the pressure chamber, through a valve 5, to a nozzle 6 so as to be atomized and sprayed from the latter.

The cylinder 4 has an upper large-diameter portion 4*a* and a lower small-diameter portion 4*b* which are produced unitarily with each other from a plastic or the like material at a good yield.

A sucking pipe 7 is connected to the lower end of the small-diameter portion 4*b* of the cylinder, with a check valve 8 interposed therebetween, the check valve consisting of a valve seat and a check ball, and is adapted to allow the flow of liquid only in the direction from the bottom of the liquid container to the small-diameter portion 4*b* of the cylinder.

A laterally extending flange 9 is provided at the upper end of the cylinder 4. The flange 9 is held against the opening edge of the neck portion 2 of the container, through a medium of a packing 10.

At the same time, a cylindrical supporting member 11 is screwed around the outer periphery of the neck portion 2, such that a pressing plate 12 provided on the supporting member 11 presses the flange 9, thereby to hold the cylinder 4 within the container 1.

A cylindrical shroud wall 13 is provided on the supporting member 11 at a portion of the latter above the pressing plate 12, for cooperation with a later-mentioned head cover 19 to prevent contaminants from coming into the atomizer.

The pressing plate 12 has a central through bore 15 through which passed is a conduit pipe 16. The through bore 15 is concentric with the circular opening of the cylinder. A first piston 17 is formed unitarily with the end of the conduit pipe 16 within the large diameter portion 4*a* of the cylinder 4.

The first piston 17 is provided with an opening which communicates the passage in the conduit pipe 16. The opening of the first piston 17 is formed into a valve seat 18. An upper and a lower lips are provided on the periphery of the first piston 17, so as to smoothen the up and downward movement of the conduit pipe 16. A head cover 19 secured to the upper end of the conduit pipe 16 is provided with a nozzle 6 formed in its side wall. The nozzle 6 communicates the passage in the conduit tube 6 through a passage 21 formed in the head cover 19.

A second piston 22 is received by the large-diameter portion of the cylinder 4. The second piston 22 is connected, through a second conduit pipe 23, to third piston 24 which is adapted to slide in the small-diameter portion of the cylinder 4.

The small-diameter portion 4*b* of the cylinder 4, the third piston 24 and the conduit pipe 23 in combination form a pressurizing chamber 3, while the first and the second pistons 17, 22 in combination define a valve chamber 26.

The valve chamber 26 communicates the passage of the conduit pipe 23, through a port 27 of the piston 22, while the passage of the conduit pipe 23 in turn communicates the inside of the small-diameter portion 4b of the cylinder 4 through a bore 28 formed in the third piston 24. Namely, the pressurizing chamber 3 and the valve chamber 26 communicate each other and, therefore, are kept at an equal pressure.

A valve body 29 formed at the upper end of the second piston 22 constitutes, in combination with the valve seat 18, the aforementioned valve 5.

The valve body 29, second piston 22, conduit pipe 23 and the third piston 24 are formed integrally from a plastic or the like material. This integral body therefore will be referred to as an operation member M, in the description of operation which will be made later. However, the integral formation of these members is not exclusive, and the valve body 29 may be formed separately from and connected to the second piston 22 and other members, if the occasion demands. The operation body M can be depressed through the first piston. In addition, the operation body M can be moved downward, independently from the first piston 17, when the pressure in the valve chamber 26 is increased, so as to move the valve body 29 away from the valve seat 18.

A spring 30 is interposed between the third piston 24 and the small-diameter portion 4b of the cylinder 4. This spring 30 acts to bias the second and the third pistons 22, 24 upward, so as to enlarge the space of the pressurizing chamber 3, thereby to cause a sucking of the liquid, and to bring the valve body 29 into contact with the valve seat 18.

A small port 31 is formed in the wall of the upper portion of the large-diameter portion 4a of the cylinder 4. The arrangement is such that the air is introduced through the annular gap between the supporting member 11 and the conduit pipe 16 and then through the small port 31 into the container, thereby to prevent the establishment of vacuum in the latter. Another small port 32 is formed in the wall of the lower portion of the large-diameter portion 4a of the cylinder 4, for introducing and ejecting air to smoothen the up and downward movement of the second piston 22.

In operation, as the head cover 19 is depressed manually, the first, second and the third pistons are pressed and moved downward, through the contact of the valve seat 18 with the vave body 29, and are moved downward overcoming the biasing force of the spring 30, thereby to increase the pressure within the pressurizing chamber 3.

The product of the liquid pressure and the differential of effective areas of the second and the third pistons 22, 24 is the force acting to depress the operation body M.

Therefore, as the liquid pressure comes to exceeds a predetermined pressure as a result of the depression of the head cover 19, the operation body M is depressed by the liquid pressure, independently from the first piston 17, so that the valve body 29 is moved away from the valve seat 18. As the valve 5 is opened in the described manner, the pressurized liquid in the pressurizing chamber 3 is forcibly sent through the valve chamber 26 and the conduit pipe 16 to the nozzle 6, and atomized from the latter.

The pressure in the pressurizing chamber 3 is decreased as a result of the atomization. As the pressure comes down below the predetermined pressure, the operation body M is moved up by the force of the spring 30, so as to bring the valve body 29 into contact with the valve seat 18.

Consequently, the valve 5 is closed to stop the atomization. Since the spring 30 exerts a force to reduce the length of the valve chamber 26 of the large diameter, during the atomization, the pressure within the pressurizing chamber 3 is maintained higher than the predetermined pressure, so as to ensure a good atomization even in the periods immediately after the start of atomization and immediately before the stop of the atomization.

As has been described, according to the invention, a good atomization is ensured by an extremely simple construction for actuating the valve, consisting of a pressurizing chamber for pressurizing the liquid to be atomized and a valve chamber communicating the pressurizing chamber. More specifically, the atomizer of the invention includes a cylinder 4 having a large-diameter portion 4a and the small-diameter portion 4b formed unitarily with each other, a first piston 17 adapted to be slidingly moved within the large diameter portion 4a, and an operation body M consisting of a second piston 22 adapted to slide within the large-diameter portion 4a, a third piston 24 adapted to be slidingly moved in the small-diameter portion 4b and a valve body 29 which are formed integrally with one another or suitably or connected to one another. This simplified structure affords a good yield of production of the atomizer, as well as a smooth atomizing operation. At the same time, the simplified structure is less likely to incur troubles or failures and can ensure an improved durability of the atomizer. In addition, the valve chamber disposed at the neck portion of the container is effective to lower the centroid of the container, thereby to stabilize the latter.

Figure 2:
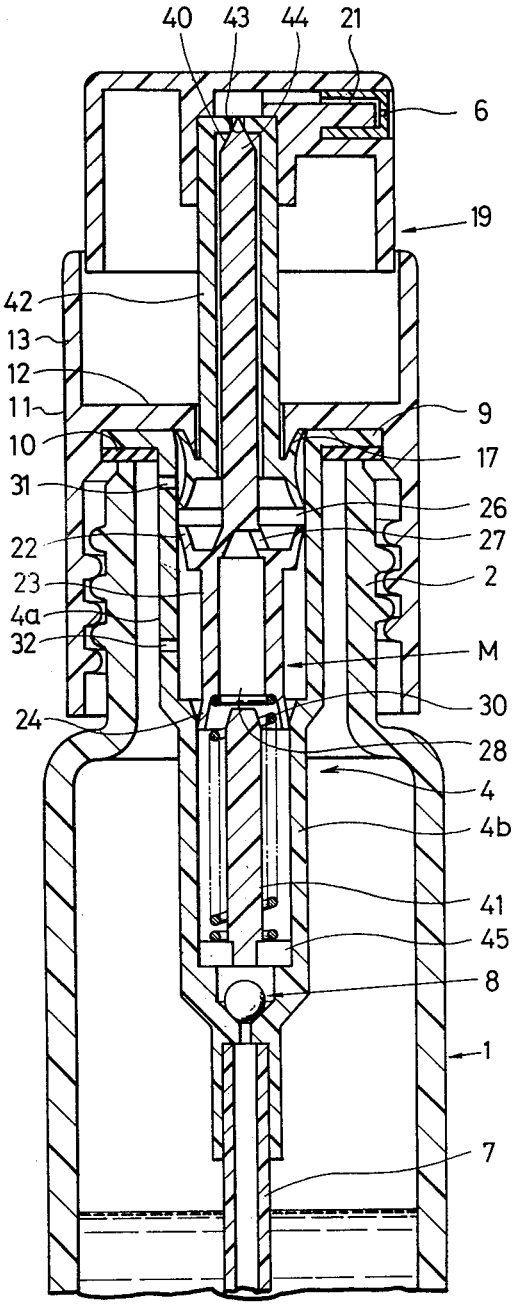
FIG. 2 is a longitudinal sectional view of another embodiment of the present invention.

Referring now to FIG. 2 showing a second embodiment of the invention, a stop valve 40 communicating the nozzle 6 is disposed in the vicinity of the nozzle, so as to improve the atomization. Further, a rod-like member 41 is fixed to the inside of the pressurizing chamber 3 of the cylinder 4, so as to enhance the pressurizing efficiency in the pressurizing chamber 3.

A conduit tube 42 connected to the first piston 17 has a passage of a diameter slightly larger than that in the foregoing first embodiment as shown in FIG. 1. A valve seat 43 is formed at the upper end of the passage. A valve body 44 formed unitarily with the upper portion of the second piston 22 has a rod-like shape, and is adapted to be received by the passage of the conduit pipe 42, so that the upper end of the valve body 44 may engage the valve seat 43. Therefore, the pressurized liquid is obliged to pass through the annular gap between the long rod-like valve body 44 and the wall of the passage of the conduit pipe 42. That is, the distance between the nozzle 6 and the stop valve is conveniently shortened. The rod-like member 41 is fixed, through a fixing member 45 having a passage bore for the liquid, to the bottom of the small-diameter portion 4b of the cylinder 4, so that it may be inserted into the conduit pipe 23 so as to enhance the pressurizing efficiency. Portions of the second embodiment other than specifically mentioned above are materially identical with those of the first embodiment.

I claim:

1. A liquid atomizer having a piston adapted to be reciprocally moved within a cylinder to suck up and pressurize a liquid, and a nozzle from which the pressurized liquid is atomized, said atomizer comprising:

a liquid container containing the liquid to be atomized and having a neck portion formed at its upper end portion, a fixed cylinder having an upper large-diameter portion and a lower small-diameter portion, said cylinder being inserted into said container through the opening of said neck portion in such a manner as to extend from said neck portion toward the bottom of said container, a supporting member adapted to be fixed to said neck portion so as to make said neck portion hold said cylinder, a first piston adapted to be slidingly moved in the large-diameter portion of said cylinder, a first conduit pipe extending upwardly from said first piston to make said nozzle and the source in said large-diameter portion communicate with each other, a valve including a valve seat formed on said first conduit pipe and a cooperating valve body and adapted to open and close the passage of said first conduit pipe, a second piston connected to said valve body and adapted to be slidingly moved in said large-diameter portion of said fixed cylinder, said second piston being of the same diameter as said first piston and cooperating with said first piston in defining therebetween a valve chamber, a second conduit pipe connected to the lower end of said second piston and making the space in said small-diameter portion communicate with said valve chamber defined above said second piston, a third piston connected to the lower end of said second conduit pipe and adapted to be slidingly moved in said small-diameter portion, a spring disposed between said third piston and the lower end of said small-diameter portion and adapted to upwardly bias an operation body which consists of said valve body of said valve, said second piston, said second conduit pipe and said third piston, a suction pipe connected to the lower end of said small-diameter portion for sucking up the liquid into a pressurizing chamber defined by said cylinder and said operation body, and a check valve interposed between said suction pipe and said small-diameter portion and adapted to allow only the flow of the liquid directed to said pressurizing chamber, said second piston being larger than said third piston, whereby when the first piston is depressed, said valve provided on said second piston is opened as a result of the difference in area between said second piston and said third piston.

2. A liquid atomizer as claimed in claim 1, wherein said first conduit pipe has a long cylindrical shape, and is provided at its upper end with a valve seat, while the valve body cooperating with said valve seat has an elongated rod-like form and received by the passage in said conduit pipe.

3. A liquid atomizer as claimed in claim 1, wherein a rod-like member is fixed to the inside of said small-diameter portion of said cylinder, said rod-like member being adapted to be inserted into said second conduit pipe when said operation body is moved downward.

4. A liquid atomizer as claimed in claim 1, wherein a small ventilation port is formed in the wall of said large-diameter portion of said cylinder at an upper portion of said large-diameter portion, so that air may be introduced into said container through the gap between said supporting member and said first conduit pipe and then through said small ventilation port.

5. A liquid atomizer as claimed in claim 1, wherein a small port is formed in the wall of said large diameter portion at a lower portion of the latter, so as to smoothen the up and downward movement of said operation body in said cylinder.

* * * * *